US011478762B2

(12) United States Patent
Gebauer et al.

(10) Patent No.: US 11,478,762 B2
(45) Date of Patent: Oct. 25, 2022

(54) PRODUCTION MODULE AND METHOD FOR PRODUCING SOLID MEDICAMENTS

(71) Applicant: Hüttlin GmbH, Schopfheim (DE)

(72) Inventors: Christian Gebauer, Kandern (DE); Marc Michaelis, Loerrach (DE); Christian Karl Paasche, Bad Saeckingen (DE); Matthias Boerner, Schopfheim (DE); Syed Muhammad Mushahid Azher, Weil am Rhein (DE)

(73) Assignee: HÜTTLIN GMBH, Schopfheim (DE)

( * ) Notice: Subject to any disclaimer, the term of this patent is extended or adjusted under 35 U.S.C. 154(b) by 684 days.

(21) Appl. No.: 16/334,974

(22) PCT Filed: Jul. 20, 2017

(86) PCT No.: PCT/EP2017/068360
§ 371 (c)(1),
(2) Date: Mar. 20, 2019

(87) PCT Pub. No.: WO2018/054577
PCT Pub. Date: Mar. 29, 2018

(65) Prior Publication Data

US 2020/0016552 A1 Jan. 16, 2020

(30) Foreign Application Priority Data

Sep. 21, 2016 (DE) ..... 10 2016 218 135.1

(51) Int. Cl.
*B01F 3/18* (2006.01)
*B01F 15/02* (2006.01)
(Continued)

(52) U.S. Cl.
CPC ..... *B01F 23/60* (2022.01); *B01F 35/714* (2022.01); *B01F 35/71805* (2022.01); *B01F 35/7547* (2022.01); *A61J 3/10* (2013.01)

(58) Field of Classification Search
CPC ..... B01F 35/714; B01F 33/82; B01F 23/60; B01F 25/71805; B01F 35/7547
See application file for complete search history.

(56) References Cited

U.S. PATENT DOCUMENTS

2001/0043848 A1 11/2001 Boos
2012/0061869 A1* 3/2012 Boeckx ..... B29B 7/726 425/110

(Continued)

FOREIGN PATENT DOCUMENTS

CH 686343 3/1996
CN 1053755 A 8/1991

(Continued)

OTHER PUBLICATIONS

Intellectual Property Office of People's Republic of China Office Action and Search Report for Application No. 201780058178.3 dated May 10, 2021 (21 pages including English translation).

(Continued)

*Primary Examiner* — Elizabeth Insler
(74) *Attorney, Agent, or Firm* — Michael Best & Friedrich LLP

(57) ABSTRACT

A production module for producing solid medicaments in individual batches, comprising a supplying device for supplying powdered starting materials, a mixing device connected to the feeding device and is intended for working the supplied powdered starting materials into a product, a final working device connected to the mixing device and is intended for the final production of an end product from the worked starting materials, and a control device for automatically controlling the supplying device and the mixing device and the final working device. Diverters allow a batch to be passed on from the supplying device to the mixing device and from the mixing device to the final working device without any backmixing. Data of all the process (Continued)

sensors and quality sensors of the production module are linked with the respective batch by the control device such that tracking and tracing of the batches is made possible.

19 Claims, 4 Drawing Sheets

(51) Int. Cl.

| | |
|---|---|
| ***B01F 23/60*** | (2022.01) |
| ***B01F 35/71*** | (2022.01) |
| ***B01F 35/75*** | (2022.01) |
| *A61J 3/10* | (2006.01) |

(56) References Cited

U.S. PATENT DOCUMENTS

| | | | |
|---|---|---|---|
| 2013/0094324 | A1 | 4/2013 | Hildreth et al. |
| 2016/0310365 | A1 | 10/2016 | Boeckx et al. |

FOREIGN PATENT DOCUMENTS

| | | | |
|---|---|---|---|
| CN | 202570054 | U | 12/2012 |
| CN | 103768988 | A | 5/2014 |
| CN | 204799164 | U | 11/2015 |
| DE | 3390423 | | 8/1996 |
| DE | 202010015580 | | 3/2012 |
| EP | 1157736 | | 11/2001 |
| EP | 2427166 | | 10/2013 |
| JP | 11235377 | | 8/1999 |
| JP | 5918808 | B2 | 5/2016 |
| WO | 03028698 | | 4/2003 |

OTHER PUBLICATIONS

International Search Report for Application No. PCT/EP2017/068360 dated Nov. 17, 20107 (English Translation, 3 pages).

Intellectual Property India First Examination Report for Application No. 20197010536 dated Jun. 30, 2021 (6 pages including English translation).

English translation of Chinese Office Action for Application No. 201780058178.3 dated Apr. 1, 2022 (6 pages).

* cited by examiner

PRODUCTION MODULE AND METHOD FOR PRODUCING SOLID MEDICAMENTS

BACKGROUND OF THE INVENTION

The present invention relates to a production module for producing solid medicaments. Solid medicaments are intended to mean tablets, pills or capsules.

The processing of pharmaceutical powders to form solid medicaments has been known for some decades. The batch-wise processing of pharmaceutical powders is likewise widely known. Furthermore, semi-continuous and continuous process management for the processing of pharmaceutical powders is known from EP 2 427 166 B1, CH 686343 A5, and from EP 1 157 736 A1.

These documents disclose, in particular, semi-continuously operating systems which have a premixing source, one or more wet granulators operating in parallel, and one or more fluidized-bed dryers operated in series. In the semi-continuous case, however, all these components only operate semi-automatically. The system therefore relies on a user confirming each process step manually, and in this case having to act himself A process therefore takes place as follows, for example:

- a premix is manually produced in a mixing apparatus
- the mixing apparatus is manually emptied into a container
- the connection between the mixing apparatus and the container is in this case manually established and disconnected
- the container is manually moved to the actual system using technical apparatus, and then is manually connected to the system
- the premix is delivered to the wet granulator by command input, and the granulating process is always started by manual command input
- the wet granulate is automatically placed into an intermediate storage unit
- from the intermediate storage unit for the wet granulate, the wet granulate is automatically sucked into a first fluidized-bed chamber for drying, predried in a first step and optionally dried further automatically in further fluidized-bed apparatuses
- after the fluidized-bed apparatuses, the dried granulate is placed by manual command input into a mill, and subsequently into a container; the container is transported in a similar way to that described above to a double press or a capsule filler.

Such process management, however, has some disadvantages. For instance, in the case of manual disconnection and connection of the connectors of the container and the mixing apparatus or other system components, there is always the risk of handling errors by the user. Substances that constitute a risk for humans and the environment may therefore escape. Corresponding safety measures to ensure risk-free coupling are elaborate and cost-intensive. If the granulate is furthermore stored in an intermediate container, as time goes on, it may compact under its own weight and stick together. This breaks down the granulate structure previously produced, so that an entire production batch may be lost. Because of the series connection of the fluidized-bed apparatuses, failure of the entire production occurs in the event of failure of only a single fluidized-bed apparatus.

SUMMARY OF THE INVENTION

The production module according to the invention comprising a plurality of process units for producing solid medicaments in individual lots makes it possible to process pharmaceutical powders fully automatically to form solid medicaments, in particular tablets and capsules. By the automation, automatic compliance with process limits for all important or necessary process parameters takes place in each process unit of the production module. This furthermore allows automatic detecting of technical problems that arise in each individual process unit, and reporting to a user, in particular by means of an HMI, i.e. a human-machine interface. Lastly, the automation furthermore allows automatic cleaning of the entire production module, or in particular also individual process units, after a production process. During production, delivery of defined, in particular small, product quantities, the lots, from an upstream process unit to a downstream process unit preferably takes place, without having to remove the product from the production module. The manufacturing steps within the production module may preferably be matched to such lots, mixing of the individual lots being very substantially avoided. There is furthermore a possibility of checking the product quality of each lot, preferably in each process unit. Furthermore, the recorded production data from each device and each unit are preferably linked with each respective lot and stored, so that the process path of this lot through the individual modules and units can be tracked. Furthermore, the substance name, material number, batch number, production date, mass of the respective batch and dosing factor (purity factor of the excipients and of the API) of the substances which are weighed into the powder sources (IBC) are ideally made available manually by the user or by scanning these data to the control device of the production module. Scanning is intended, in particular, to mean that said parameters are present in coded form on a storage container so that when connecting the storage container to the supply device, manual or automatic recording the coded parameters can be read out and supplied to the control device. This information is automatically linked with each of these respective batches consisting of lots. With the linking of the lots with the process, quality data and production data, as well as the material data (substance name, material number, production date, batch number, dosing factor, mass of the respective batches) of the substances weighed into the powder sources, traceability of this lot in terms of the process and real-time tracking are made possible.

The production module comprises a supply device, a mixing device, a final processing device, a cleaning device and a control device. In particular, the production module has a transport network for powder and/or for granulate produced, tablets and/or capsules, this network preferably being based on lines and nodes assigned to the individual devices. By means of this transport network, the individual devices are connected to one another. Thus, in particular, the supply device is connected to the mixing device. Furthermore, the mixing device is preferably connected to the final processing device. In this way, substances can be transported, in particular fully automatically, from the supply device to the mixing device and from the mixing device to the final processing device, without manual intervention being necessary. The mixing device, the final processing device and the supply device constitute, in particular, individual process units of the production module.

The supply unit preferably has a dosing unit for each starting substance supplied. In this way, a defined quantity of starting substances can be supplied, in particular fully automatically, to the production module, in particular the mixing device. Transport of the starting substances to the mixing device can therefore be carried out fully automatically, without the intervention of a user being necessary. In this way, in particular, the safety is increased because handling errors by the user are avoided. The supply device is used in order to supply starting substances so as thus to define each lot. The starting substances are preferably powdered pharmaceutical substances. The mixing device is used in order to mix the defined lot of the starting substances supplied. Furthermore, processing, in particular granulating and/or drying, as well as coating of the starting substances supplied, may preferably take place inside the mixing device. The final processing device is used in order to finally process the mixed and/or granulated and/or coated starting substances to form an end product. This comprises, in particular, shaping of the mixed and/or granulated and/or coated starting substances. In this way, in particular, the solid medicaments can be shaped.

Furthermore, the production module comprises a control device. The control device is configured for fully automatic driving of the supply device, mixing device and the final processing device, as well as a preferably provided cleaning device. In particular, the control device is configured to control substance transport in the form of a lot from the supply device to the mixing device and from the mixing device to the final processing device. In particular, no manual intervention is therefore necessary. An entire production cycle, starting with the supply of the starting substances required until the output of the finished solid medicaments from the final processing device, therefore preferably takes place automatically and without the intervention of a user. Furthermore, the control device makes it possible to store the production data and link these data with the individual lots. By the control device, preferably, data of all the process sensors and quality sensors of the production module which are provided can be linked with the respective lot, so that subsequent tracking of each lot, or tracking of each lot in real time, is made possible.

Delivery of each lot from the supply device to the mixing device, and from the mixing device to the final processing device, can be carried out without any back-mixing by means of collecting locks. In particular, this prevents each lot from coming into contact with other substances, which are not intended for processing of the lot. In particular, a plurality of lots can therefore be processed simultaneously in the production module, since separation of the individual lots is ensured at all times by the collecting locks.

A first collecting lock is preferably arranged between the supply device and the mixing device. The first collecting lock is used to prevent fluid communication between the supply device and the mixing device. In this way, quality assurance is made possible. Thus, the starting material can be transferred from the supply device into the first collecting lock. From the first collecting lock, the starting material can subsequently be supplied to the mixing device. Inside the first collecting lock, there is therefore always a defined quantity of starting materials, which are to be delivered to the mixing device. Furthermore, for highly accurately dosed powdered pharmaceutical substances, the first collecting lock advantageously has at least one stirring member for mixing and/or uniformizing and/or homogenizing the powdered substances, as well as ideally also at least one instrument gland for at least one quality sensor and at least one quality sensor for monitoring the purity of the dosed substances, mixing quality, particle size distribution and optionally input moisture content of the highly accurately dosed pharmaceutical powders under constant conditions. The first collecting lock preferably has at least one opening for input of the powdered substances, and an outlet.

A second collecting lock is preferably arranged between the mixing device and the final processing device. The second collecting lock is used in order to, in particular temporarily, prevent continuous fluid communication between the mixing device and the final processing device, as well as to hold material for an uninterrupted process of production in the final processing device in the event of a delay of the process in the upstream modules. In this way, again, quality assurance is made possible. From the mixing device, a product produced by mixing and/or granulating and/or coating the starting substances can therefore be transferred into the second collecting lock. From the second collecting lock, the product can be transferred into the final processing device, so that there is no direct fluid communication between the mixing device and the final processing device. This second collecting lock may ideally, like the first collecting lock, be under constant conditions equipped with at least one stirring member, at least one instrument gland for at least one quality sensor for checking the substances mixed and/or granulated and/or dried and/or coated in the mixing device in respect of purity, mixing quality, particle size distribution and optionally moisture content of the pharmaceutical substances. Furthermore, it is advantageously provided that the second collecting lock can mix the processed product from the mixing device with further substances. The further substances may, in particular, be added to the second collecting lock by means of an additional dosing unit. The further substances are, in particular, magnesium stearate or other additives referred to as an external phase.

Preferably, a bifurcation is installed between the second collecting lock and the final processing device. By means of the bifurcation, a lot can be ejected and, in particular, transferred into a refuse container. This prevents a product, which does not fulfill predefined quality criteria, from continuing to remain in the transport network of the production module. In this way, in particular, contamination of the transport network with inferior-quality products is prevented.

A third collecting lock is preferably arranged between the final processing device and a module boundary of the production module. A module boundary is in this case intended to mean a boundary of the production module, at which finished end product, i.e. solid medicaments, leaves the production module. Likewise, such a boundary at which the starting substances are introduced into the production module is preferably to be regarded as a module boundary. By the third collecting lock, fluid communication between an environment of the production module and the final processing device is thus prevented. In this way, quality assurance is again made possible. Furthermore, contamination of the production module by external influences is prevented. The third collecting lock may ideally be a dust collector or simple container. Quality sensors are preferably fitted to the third collecting lock, in order to allow quality controls under constant conditions.

Particularly advantageously, the first collecting lock and/or the second collecting lock and/or the third collecting lock and/or the fourth collecting lock allow monitoring of the product quality. Thus, in particular, at least one quality sensor is fitted inside the first collecting lock and/or the second collecting lock and/or in the third collecting lock and/or in the fourth collecting lock. With the quality sensor, a quality of the content of the respective collecting lock can be recorded. In this way, it is made possible for the control device to determine and monitor the quality of the content of the collecting locks.

By means of the supply device, at least one active pharmaceutical ingredient and at least one pharmaceutical excipient can preferably be supplied. Particularly preferably, an active pharmaceutical ingredient and a multiplicity of different pharmaceutical excipients are supplied. Both the active pharmaceutical ingredient and the pharmaceutical excipient are preferably a powder.

The final processing device preferably comprises a tablet press and/or a capsule filler. By the tablet press and/or the capsule filler, solid medicaments can be manufactured from the product produced by the mixing device by mixing the starting substances. In this way, different geometrical shapes of the solid medicaments can be produced. Depending on the application, coating of the tablets produced in an optional coating device is preferably furthermore carried out.

The supply device comprises, in particular, at least one dosing unit for highly accurate dosing of the powdered pharmaceutical constituents. Furthermore, the supply device preferably has a collection container for receiving the highly accurately dosed powdered pharmaceutical substances. Advantageously, this collection container may alternatively be equipped with at least one stirring member for mixing the powdered substances, as well as ideally also with at least one instrument gland for at least one quality sensor and at least one quality sensor for monitoring the purity of the dosed substances, mixing quality, particle size distribution and optionally input moisture content of the highly accurately dosed pharmaceutical powders. The collection container has at least one opening for introduction of the powdered substances, and an outlet.

The mixing device preferably comprises a fluidized-bed system, in which drying and/or granulation can be carried out, or a wet granulator. The wet granulator preferably comprises an extruder and/or a high-shear mixer. In particular, a mixing process in the broadest sense takes place in the mixing device. Thus, in particular, the mixing device is not intended to mean a screw doser, since only substances in ultrapure form are present in this case. The mixing process may therefore be considered to be synonymous with a drying process and/or a granulating process.

A coating device is preferably arranged downstream of the tablet press and/or the capsule filler. The coating device is used in particular for coating the tablets produced, or else the capsules produced. Preferably, provision is furthermore made for a fourth collecting lock to be arranged between the tablet press and/or capsule filler and the coating device. The fourth collecting lock again allows quality assurance to be made possible. By the fourth collecting lock, direct fluid communication between the tablet press and/or the capsule filler and the coating device is prevented. By the fourth collecting lock, fluid communication between the final processing device and the surroundings is therefore prevented. Furthermore, quality assurance is again made possible. Furthermore, contamination of the final processing device by external influences is prevented. A fourth collecting lock may, in particular, be provided even when the production module does not have a third collecting lock.

Furthermore, the production module preferably comprises a cleaning device which can be started semiautomatedly or fully automatedly by the user via a human-machine interface and can run. In this case, the supply device, the mixing device and the final processing device may ideally be cleaned together and/or separately from one another, so that partial by manual recleaning by the user (WIP—Wipe in Place), but preferably no manual recleaning (CIP—Clean in Place), is necessary.

Preferably, quality sensors are fitted to the individual process units of the mixing device, in order to enable delivery of good product, meaning that predefined quality features are fulfilled, into the transport network, or as far as possible not to let substandard product, meaning that predefined quality features are not fulfilled, enter the transport network and to eject it directly after or from the units of the mixing device manually or automatically with a suction unit into a refuse container.

In particular, the invention further relates to a method for producing solid medicaments with a production module as described above. In this case, provision is made for starting substances to be used to be dosed highly accurately into the first collecting lock by means of a dosing unit in the supply device in a fixed quantity. In this way, each lot is defined. Particularly advantageously, it is in this case provided that the same quantities are always used during production. Particularly advantageously, the same mass proportions are always dosed.

When carrying out the method described above, preferably each lot is processed separately in the supply device and subsequently separately in the mixing device and subsequently separately in the final processing device. Provision is furthermore preferably made for the respective lot to be transported after each concluded process step into a collecting lock in order to be checked there by means of quality sensors for its suitability for further processing.

Particularly advantageously, each lot is granulated and dried in the mixing device only in a process unit. As an alternative, each lot is granulated in the mixing device in an extruder or in a high-shear granulator, and subsequently dried in a process unit of the mixing device. Since the mixing device advantageously has a plurality of process units, the mixing device can simultaneously process a plurality of lots. In this case, the individual lots are preferably kept separate from one another, so that mixing of the individual lots is prevented.

Advantageously, provision is furthermore made for further substances to be supplied into the second collecting lock by at least one additional dosing unit. In this way, the further substances can be mixed with the respective lot, which is in the second collecting lock. The further substances are, in particular, magnesium stearate or other additives referred to as an external phase.

Preferably, checking of each lot by quality sensors is carried out, wherein the quality sensors are fitted in the individual process units of the mixing device. In this way, it is possible to decide whether a respective lot is released into the transport network or ejected directly after or from the process units of the mixing device manually or automatically into a refuse container. In this way, if predefined quality parameters are not achieved, each lot can be ejected through a bifurcation into a refuse container before the lot reaches the final processing device.

BRIEF DESCRIPTION OF THE DRAWINGS

Exemplary embodiments of the invention will be described in detail below with reference to the appended drawing. In the drawing.

DETAILED DESCRIPTION

Figure 1:
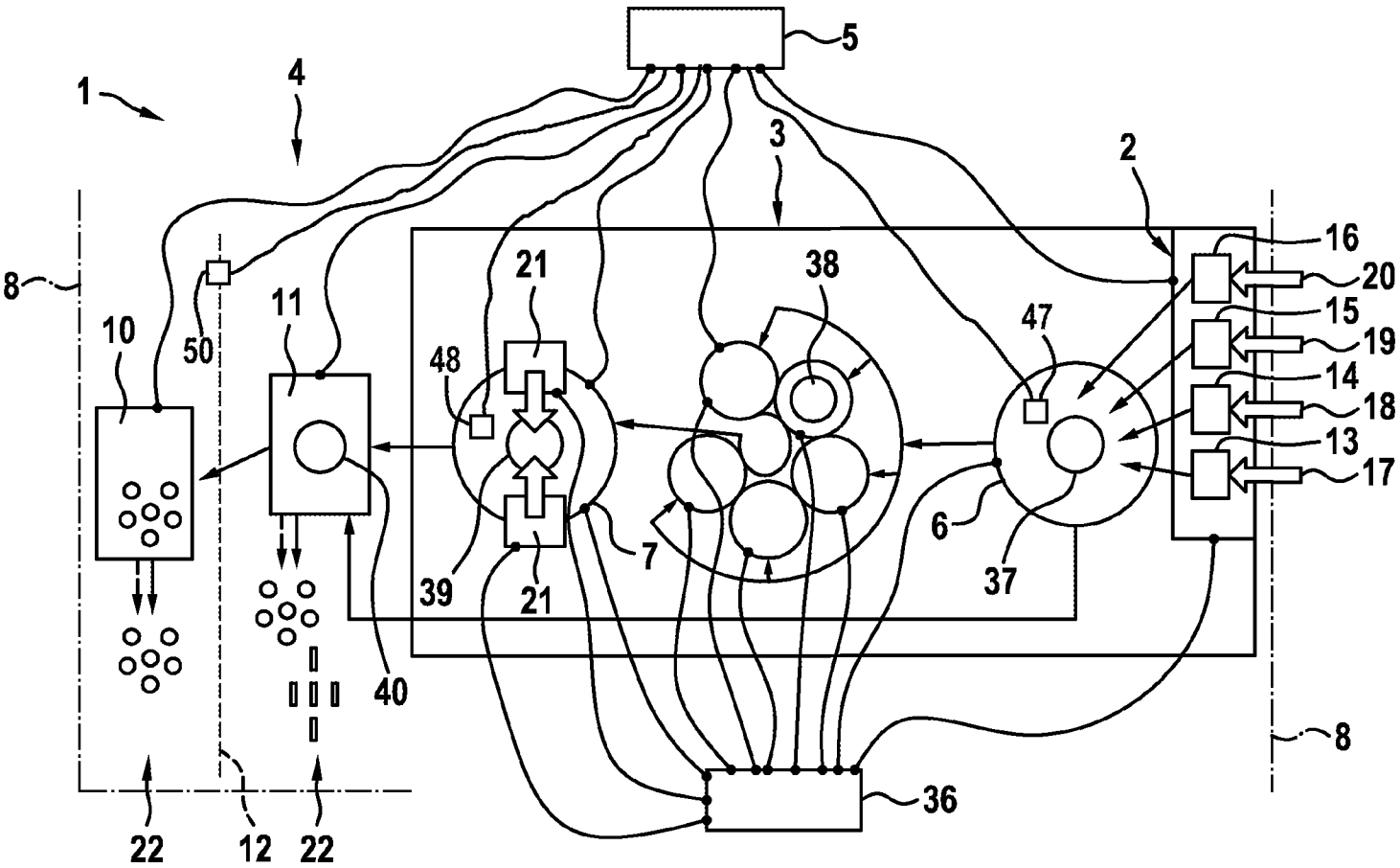
FIG. 1 is a schematic depiction of a production module according to one exemplary embodiment of the invention.

FIG. 1 schematically shows a depiction of a production module 1 for manufacturing solid medicaments 22, according to one exemplary embodiment of the invention. The production module 1 comprises a supply device 2, a mixing device 3, a final processing device 4 and a control device 5 and a cleaning device 36. The supply device 2, the mixing device 3 and the final processing device 4 represent preferred process units of the production module 1.

Via the supply device 2, starting substances 17, 18, 19, 20 can be supplied through a module boundary 8 to the production module 1. Furthermore, the starting substances 17, 18, 19, 20 can be transported to the mixing device 3 via the supply device 2. This is shown in FIG. 2.

Figure 2:
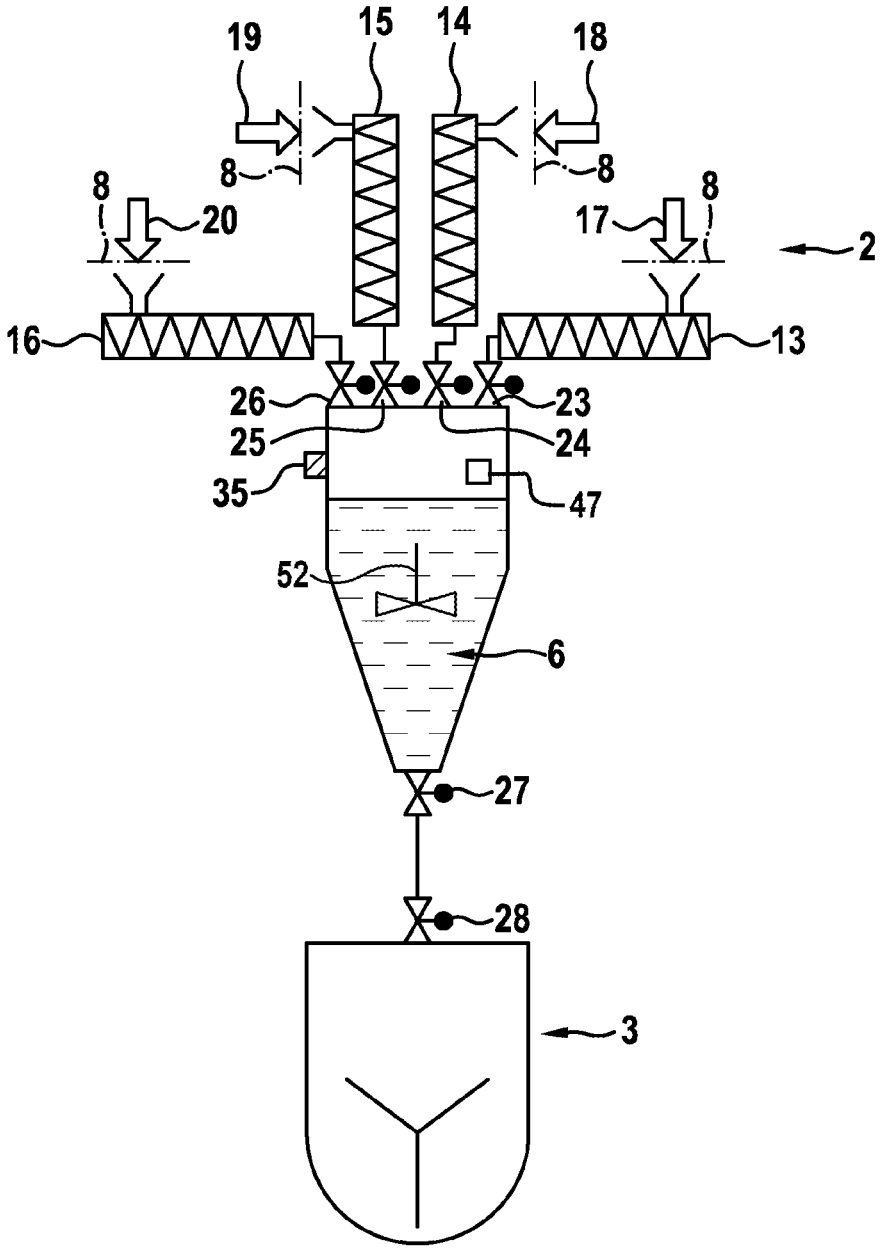
FIG. 2 is a schematic depiction of a first subregion of the production module according to the exemplary embodiment of the invention.

FIG. 2 schematically shows a subregion of the production module 1. In particular, the supply device 2 and the mixing device 3 are represented schematically. The starting substances 17, 18, 19, 20 are, in particular, an active pharmaceutical ingredient 17 and a first pharmaceutical excipient 18, a second pharmaceutical excipient 19 and a third pharmaceutical excipient 20. Depending on the application, more or fewer starting substances 17, 18, 19, 20 may be used. The inlets for the starting substances 17, 18, 19, 20 are preferably releasably connected to source containers (not represented). The starting substances are, in particular, pharmaceutical powders.

The supply device 2 comprises a first dosing unit 13, a second dosing unit 14, a third dosing unit 15 and a fourth dosing unit 16. The active pharmaceutical ingredient 17 supplied can be dosed by means of the first dosing unit 13. The first pharmaceutical excipient 18 can be dosed by means of the second dosing unit 14, the second pharmaceutical excipient 19 can be dosed by means of the third dosing unit 15, and the third pharmaceutical excipient 20 can be dosed by means of the fourth dosing unit 16. In this way, a composition of the starting substances 17, 18, 19, 20 can be adjusted precisely.

The starting substances 17, 18, 19, 20 dosed in this way are therefore present in a defined quantity. Particularly advantageously, there is a first collecting lock 6 between the supply device 2 and the mixing device 3. In this case, provision is made for the first dosing unit 13 to be connected to the first collecting lock 6 optionally by means of a first nonreturn valve 23, the second dosing unit 14 to be connected to the first collecting lock 6 optionally by means of a second nonreturn valve 24, the third dosing unit 15 to be connected to the first collecting lock 6 optionally by means of a third nonreturn valve 25, and the fourth dosing unit 16 to be connected to the first collecting lock 6 optionally by means of a fourth nonreturn valve 26. Furthermore, the collecting lock 6 has a filter 35 to allow an air flow into and out of the collecting lock 6. Preferably, the dosing units 13, 14, 15, 16 may extend into a common manifold pipe and thereby be connected to the collecting lock 6. At the same time, there is a fifth nonreturn valve 27 at an exit of the first collecting lock 6, that is to say downstream of the collecting lock 6. The fifth nonreturn valve 27 is preferably opened only when the first optional nonreturn valve 23, the second optional nonreturn valve 24, the third optional nonreturn valve 25 and the fourth optional nonreturn valve 26 are all closed. The first collecting lock 6 therefore makes it possible for direct fluid communication between the dosing units 13, 14, 15, 16 and therefore the supply device 2 and the mixing device 3 to be prevented. In this way, quality assurance can be made possible. In particular, in the first collecting lock 6, there is a quality sensor 47, by means of which a check of the quality of the starting substances 17, 18, 19, 20 is made possible. The quality sensor 47 is advantageously connected to the control device 5, so that the control device 5 can carry out the quality control fully automatically. Furthermore, there is ideally at least one stirring member 52 in the collecting lock 6 for uniformizing and homogenizing the dosed bulk material.

The at least one mixing device 3 is connected downstream of the first collecting lock 6. The mixing device 3 has a sixth nonreturn valve 28 at its entry. With the sixth nonreturn valve 28, a supply of the starting substances 17, 18, 19, 20 to the mixing device 3 can be regulated.

Mixing devices 3 are intended to mean only collections of process units in which a mixing process in the broadest sense of different materials takes place. In particular, the mixing device 3 is a fluidized-bed system, a wet granulator, preferably a high-shear mixer or extruder, or another mixing apparatus. In particular, according to the invention screw dosers are not regarded as a mixing device 3, since substances in ultrapure form are present in this case.

The mixing device 3 preferably has a multiplicity of individual process units. The process units are connected by means of a distribution system and/or a separate collection system. By means of the distribution system and/or the collection system, defined product quantities can be transported between the process units and/or the supply device and/or the final processing device, ideally gravimetrically or pneumatically.

As can be seen in FIG. 1, a final processing device 4 is connected downstream of the mixing device 3. Parts of the final processing device 4 are furthermore shown in FIGS. 3 and 4. In the final processing device 4, in particular, a final manufacturing process takes place in order to manufacture solid medicaments 22.

Figure 3:
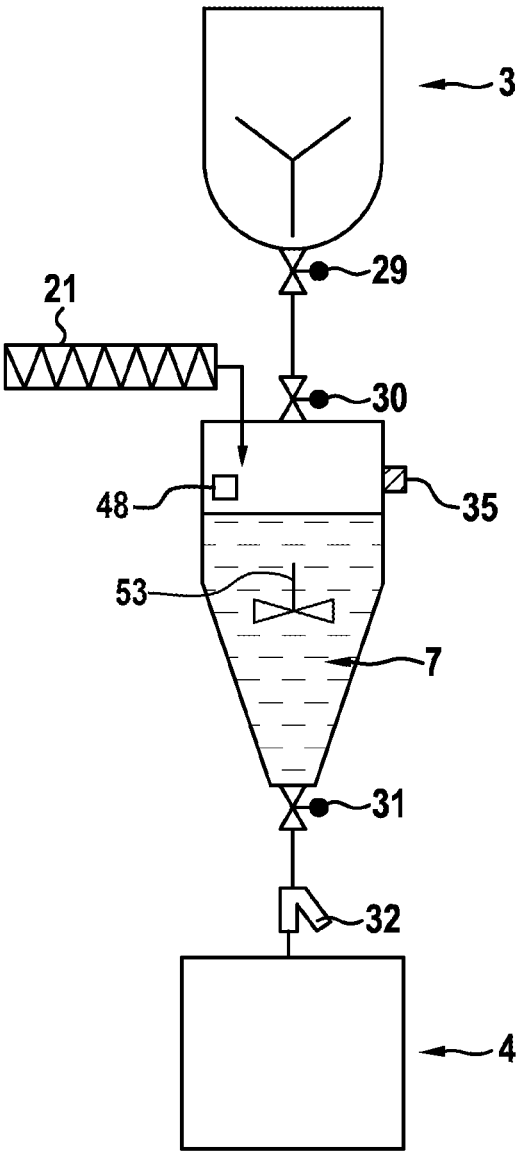
FIG. 3 is a schematic depiction of a second subregion of the production module according to the exemplary embodiment of the invention.

As can be seen from FIG. 3, a seventh nonreturn valve 29 is connected downstream of the mixing device 3. By means of the seventh nonreturn valve 29, therefore, output of the starting substances 17, 18, 19, 20 mixed and preferably also granulated by the mixing device 3 from the mixing device 3 can be controlled. Connected downstream, that is to say downstream of the mixing device 3, there is a second collecting lock 7. The second collecting lock 7 is preferably configured in terms of design in a similar way to the first collecting lock 6, with instrument glands and a stirring member 53. The second collecting lock therefore also allows interruption of fluid communication between the mixing device 3 and the final processing device 4, as well as uniformizing and/or homogenizing of the lot from the mixing device 3. Furthermore, in a preferred configuration, the second collecting lock 7 may have at least one further opening for magnesium stearate and further substances referred to as an external phase. This at least one opening is to this end ideally connected to at least one additional dosing unit 21. To this end, the second collecting lock 7 optionally has an eighth nonreturn valve 30 and ideally a ninth nonreturn valve 31. By means of the eighth nonreturn valve 30, entry of pharmaceutical granulate or powder from the mixing device 3 into the second collecting lock 7 can be controlled. By means of the ninth nonreturn valve 31, output of fluid from the second collecting lock 7 can be controlled.

Inside the second collecting lock 7, quality control may preferably again be carried out. From the second collecting lock 7, the product present therein travels to the final processing device 4, or ideally into a further storage container (not represented). In this case, a bifurcation 32 is arranged at an entry of the final processing device 4, by means of which bifurcation a feed flow of the product to the final processing device 4 is controllable. In this case, controllable means the possibility of delivering the lot of good product into the final processing device 4, or if need be the lot of good product into an IBC (intermediate bulk container—not shown), or the lot of substandard product into a refuse container (not shown).

As shown in FIG. 1, the final processing device 4 preferably comprises a tablet press or a capsule filler 11, as well as a downstream coating device 10. The coating device 10 is in this case, in particular, optional. Thus, FIG. 1 shows that finished solid medicaments 22 may be taken both from the tablet press or the capsule filler 11 and from the coating device 10. The finished solid medicaments 22 are preferably output beyond the module boundary 8.

Figure 4:
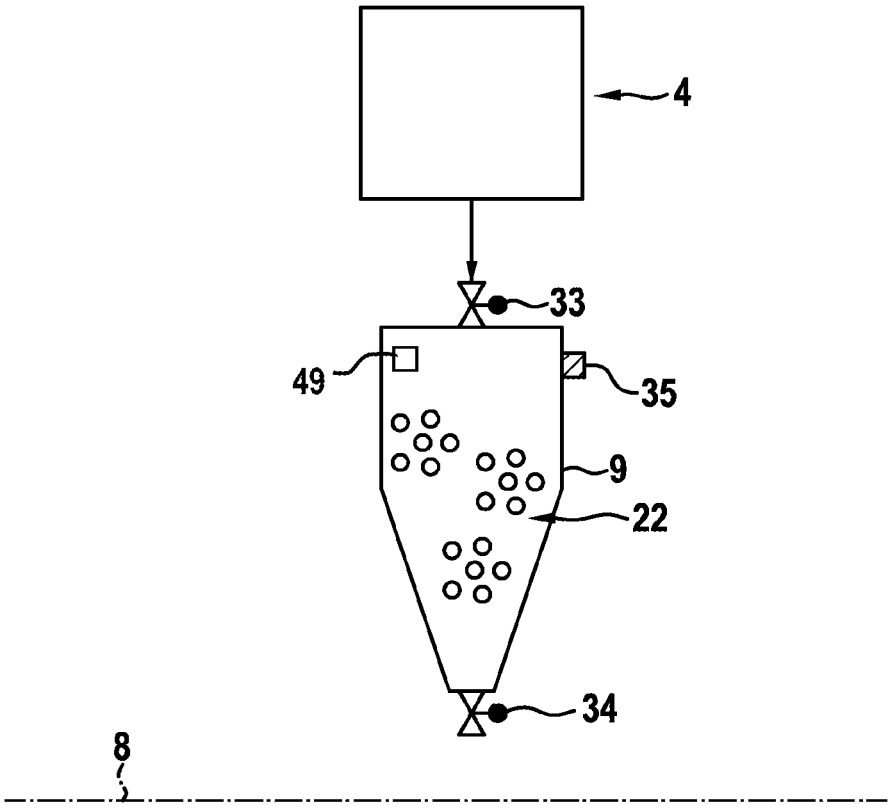
FIG. 4 is a schematic depiction of a fourth subregion of the production module according to the exemplary embodiment of the invention.

Lastly, FIG. 4 shows a third section of the production module 1. It can be seen that a third collecting lock 9 is connected downstream of the final processing device 4. The solid medicaments 22 produced can therefore be output to an environment, that is to say beyond the module boundary 8, by way of the third lock 9. The third collecting lock 9 optionally has a tenth nonreturn valve 33 at the entry and a twelfth nonreturn valve 34 at the exit. This again ensures that no fluid communication of any kind can take place between the final processing device 4 and an environment of the production module 1. Preferably, a final check of the solid medicaments 22 produced takes place inside the third collecting lock 9. Such a check is carried out particularly in terms of mass, height, diameter, hardness, and preferably the active pharmaceutical ingredient content.

If a coating device 10 is present, provision is furthermore preferably made for a fourth collecting lock 12 to be present between the tablet press or the capsule filler 11 and the coating device 10. The fourth collecting lock 12 prevents fluid communication between the coating device 10 and the tablet press or the capsule filler 11. Again, the possibility of quality assurance is thus also provided.

In particular, it is provided that all the nonreturn valves 23, 24, 25, 26, 27, 28, 29, 30, 31, 32, 33, 34, if present, can be driven by the control device 5. Furthermore, the supply device 2, the mixing device 3 and the final processing device 4, that is to say in particular the coating device 10 and the tablet press or the capsule filler 11, as well as the cleaning device 36, can preferably be driven by the control device 5. Fully automatic process operation inside the module boundary 8 is therefore preferably ensured. This means that no user interventions at all are necessary in order to produce the finished solid medicaments 22 starting from the starting substances 17, 18, 19, 20. In particular, it also avoids connecting processes between individual process units having to be produced manually by a user, with the result that possible leaks are avoided.

The production module 1 is, in particular, not enclosed by a housing. A housing is intended to mean a casing which would enclose all the process units, i.e. the supply device 2, the mixing device 3 and the final processing device 4, and would separate them from the immediate environment (GMP production space/clean room). Rather, provision is made for each process unit to have its own walls so as thus to shut off the process spaces from the environment (GMP room/clean room). In particular, this allows full accessibility of the individual process units in the event of maintenance or cleaning being required.

Production of solid medicaments 22 by means of the production module 1 described above preferably takes place as follows:

The, in particular powdered, starting substances 17, 18, 19, 20 are transported pneumatically, preferably gravimetrically from source containers to the supply device 2. The starting substances 17, 18, 19, 20 are introduced into the first collecting lock 6 highly accurately, automatically and in a coordinated manner by way of the dosing units 13, 14, 15, 16. Thus a lot is present inside the first collecting lock 6. Here, quality analyses can be carried out by quality sensors 47. In particular, quality analyses of this kind comprise recording a moisture content, a composition and a particle size distribution of the starting substances 17, 18, 19, 20, and also ideally the purity thereof. This it is made possible already at this point to perform corrections. The lot can ideally be homogenized here too. The composition can ideally be checked and ensured and corrected here by way of the dosing units 13, 14, 15, 16.

The lot from the first collecting lock 6 is delivered only when the quality is confirmed as good. During the delivery, the first nonreturn valve 23, the second nonreturn valve 24, the third nonreturn valve 25 and the fourth nonreturn valve 26, if present, are closed. Furthermore, the fifth nonreturn valve 27 is opened. This ensures that no fluid communication can take place between the supply device 2 and the mixing device 3 during the transport of the defined product quantity from the first collecting lock 6.

By means of a distribution system of the mixing device 3, the lot is delivered to preferably at least one first process unit and to preferably at least one second process unit, the process units preferably being parts of a fluidized-bed granulation system and being individual, mutually independent granulating units. A fluidized-bed granulation system therefore has a plurality of process spaces, in particular of the same type. In the process units, the supplied lot is processed, in particular mixed and/or granulated, according to a predefined method. Downstream of the mixing device 3, there is the second collecting lock 7 for collecting the products processed, in particular mixed and/or granulated and/or dried, by the mixing device 3. By quality sensors, which are optional in the individual units, in the mixing device 3, good product is delivered from the mixing device 3 via the transport network to the subsequent unit. In the case of substandard product in the individual units of the mixing device 3, a message is issued to the user on the HMI, and the user can automatically or manually remove the substandard product from the mixing device.

In the second collecting lock 7, quality control is advantageously carried out again. Defective batches can therefore already be detected early, and optionally ejected with the aid of the bifurcation 32. Furthermore, with the at least one additional dosing unit 21, it is possible to dose magnesium stearate, or other substances referred to as an external phase, highly accurately into the product being processed. By closing the optional eighth nonreturn valve 30 and opening the ninth nonreturn valve 31, the content of the second collecting lock 7 can be transported to the final processing device 4. Again, it is optionally ensured that fluid communication between the mixing device 3 and the final processing device 4 is avoided.

In particular, the content of the second collecting lock 7 is delivered to the tablet press or the capsule filler 11. Here, processing of the transferred product to form tablets or capsules is carried out. If tablets are produced, the transfer advantageously takes place into the fourth collecting lock 12. From the fourth collecting lock 12, the tablets are transferred to the coating device 10. Again, on the one hand fluid communication between the tablet press or capsule filler 11 and coating device 10 is avoided by the fourth collecting lock 12, and on the other hand the fourth collecting lock 12 makes it possible to carry out quality control.

By the coating device 10, coating of the tablets with a film is carried out. Subsequently, output of the solid medicaments 22 thereby finished takes place into a third collecting lock 9. If capsules are intended to be produced, output of the capsules, and therefore of the finished solid medicaments 22, preferably takes place from the tablet press or the capsule filler 11 into the third collecting lock 9. By the third collecting lock 9, fluid communication with the environment is again prevented, wherein a final quality test may furthermore be carried out.

The process described above can be carried out fully automatically by the control device 5. Owing to the presence of quality sensors 47, 48, 49, 50 in the collecting locks 6, 7, 9, 12 and in the supply device 2, the mixing device 3 and the final processing device 4, the first collecting lock 6, the second collecting lock 7, the third collecting lock 9, and the fourth collecting lock 12, transport and constant quality control between and in the individual units of the production module 1 is made possible. In particular no manual interventions by a user are thus necessary.

The production module 1 furthermore has the following advantages:

- Quality control in each process unit or lock during and/or after the respective process.
- The possibility of manually or automatically ejecting substandard product before the final processing device and after the units of the mixing device.
- No scale-up in terms of the apparatus size from laboratory tests to production processes, since the system can be used for both purposes because of high operating flexibility in relation to the quantities to be introduced.
- Defined product quantities of from 500 ml to 50 l per process step and process unit without removing the product from the module.
- The module ideally satisfies a containment level corresponding to from <1 μg of dust per $m^3$ of air to 5000 μg of dust per $m^3$ of air.
- Exact, fully automatic weigh-in of powders, preferably with an accuracy of at least ±1 mg.
- 100% trackability in real time of a lot through the entire production module.
- Almost 100% traceability of each defined product quantity (lot).
- Very substantial avoidance of cross-contamination between the individual lots, since fluid communication between all process units is interrupted by locks and residue-free emptying of all process units and locks is very substantially possible.
- Process unit substantially emptiable, where technically expedient.
- Process units run independently of one another, but are controlled by a common overall control and regulating device. Minimization of downtimes and quantities of reject material by constant quality control of the lots in the collecting locks between the individual process units by corresponding measurement sensors for the attributes of particle size distribution, moisture content, mixing homogeneity, temperature and purity.
- Good accessibility for users to all process units.

The invention claimed is:

1. A production module (1) for producing solid medicaments (22) in individual lots (37, 38, 39, 40), the production module comprising a supply device (2) configured to supply powdered starting substances which form the individual lots (37, 38, 39, 40), the supply device (2) having a collection container including at least one opening for introduction of the powdered substances and including an outlet, a mixing device (3) connected to the supply device (2) such that the mixing device (3) receives a defined lot of the powdered starting substances, the mixing device (3) being configured to mix and process the defined lot of the powdered starting substances to form a defined lot of mixed product, a final processing device (4) connected to the mixing device (3) such that the final processing device (4) receives the defined lot of mixed product, the final processing device (4) being configured to create a final product from the defined lot of mixed product, a first collection lock (6) between the supply device (2) and the mixing device (3), the first collection lock including a first container, a first nonreturn valve (23, 24, 25, 26) at an entrance of the first container, and a second nonreturn valve (27) at an exit of the first container, the first container being configured to receive the defined lot of the powdered starting substances from the supply device (2) via the first nonreturn valve, and being configured to forward the defined lot of the powdered starting substances from the supply device (2) to the mixing device (3) via the second nonreturn valve, and the first nonreturn valve, the second nonreturn valve and the first container being configured to temporarily prevent continuous fluid communication between the supply device (2) and the mixing device (3), a second collection lock (7) between the mixing device (3) and the final processing device (4), the second collection lock (7) including a second container, a third nonreturn valve (30) at an entrance of the second container, and a fourth nonreturn valve (31) at an exit of the second container, the second container being configured to receive the defined lot of mixed product from the mixing device via the third nonreturn valve (30), and being configured to forward the defined lot of mixed product from the mixing device (3) to the final processing device (4) via the fourth nonreturn valve (31), and the third nonreturn valve (30), the fourth nonreturn valve (31) and the second container being configured to temporarily prevent continuous fluid communication between the mixing device (3) and the final processing device (4), and a control device (5) configured to automatically control the supply device (2), the mixing device (3), the final processing device (4), the first nonreturn valve (23, 24, 25, 26), the second nonreturn valve (27), the third nonreturn valve (30), and the fourth nonreturn valve (31), the control device being configured to control the the first nonreturn valve (23, 24, 25, 26) and the second nonreturn valve (27) such that the first container receives the defined lot of the powdered starting substances from the supply device (2) via the first nonreturn valve (23, 24, 25, 26), and forwards the defined lot of the powdered starting substances from the supply device (2) to the mixing device (3) via the second nonreturn valve (27), and such that the first nonreturn valve (23, 24, 25, 26) and the second nonreturn valve (27) temporarily prevent continuous fluid communication between the supply device (2) and the mixing device (3), and the control device (5) being configured to control the the third nonreturn valve (30) and the fourth nonreturn valve (31) such that the second container receives the mixed product from the mixing device (3) via the third nonreturn valve (30), and forwards the defined lot of the mixed product from the mixing device (3) to the final processing device (4) via the fourth nonreturn valve (31), and such that the third nonreturn valve (30) and the fourth nonreturn valve (31) temporarily prevent continuous fluid communication between the mixing device (3) and the final processing device (4), wherein the first collection lock (6) and/or the second collection lock (7) have at least one stirring member in the first container and/or the second container.

2. The production module (1) as claimed in claim 1, further comprising quality sensors configured to provide quality assessment via the first collection lock (6) under constant conditions.

3. The production module (1) as claimed in claim 2, further comprising quality sensors configured to provide further quality assessment via the second collection lock (7) under constant conditions.

4. The production module (1) as claimed in claim 3, further comprising a bifurcation (32) between the second collection lock (7) and the final processing device (4), through which a batch (37, 38, 39, 40) can be unloaded.

5. The production module (1) as claimed in claim 2, wherein there is at least one quality sensor within the first collection lock (6) and/or the second collection lock (7) and/or the third collection lock (9) and/or the fourth collection lock (12), via which the quality of the content of the first collection lock (6) and/or the second collection lock (7) and/or the third collection lock (9) and/or the fourth collection lock (12) can be recorded.

6. The production module (1) as claimed in claim 1, further comprising a third collection lock (9) between the final processing device (4) and a module boundary (8) of the production module (1) in order to prevent fluid communication between the final processing device (4) and the surroundings of the production module (1).

7. The production module (1) as claimed in claim 1, wherein the supply device (2) is configured to convey at least one pharmaceutical agent (17) and at least one pharmaceutical excipient (18, 19, 20).

8. The production module (1) as claimed in claim 1, wherein the supply device (2) has at least one dosage unit (13, 14, 15, 16) for dosing the fed starting substances and/or the mixing device (3) has a fluidised bed unit and/or a wet granulator and/or the final processing device (4) has a tablet press and/or a capsule filler (11).

9. The production module (1) as claimed in claim 8, wherein the tablet press and/or capsule filler (11) is upstream from a coating device (10), whereby there is a fourth collection lock (12) between the tablet press and/or capsule filler (11) and the coating device (10) in order to prevent fluid communication between the tablet press and/or capsule filler (11) and the coating device (10).

10. The production module (1) as claimed in claim 1, wherein the supply device (2) is connected to the mixing device (3) and/or the mixing device (3) is connected to the final processing device (4) via a transport network of product pipelines and valves.

11. The production module (1) as claimed in claim 1, wherein the first container has therein the at least one stirring member.

12. The production module (1) as claimed in claim 1, wherein the second container has therein the at least one stirring member.

13. The production module (1) as claimed in claim 1, wherein the first container and the second container each have therein at least one stirring member.

14. The production module (1) of claim 1, wherein the control device (5) is configured to open the second nonreturn valve (27) only when the first nonreturn valve (23, 24, 25, 26) is closed, and wherein the control device (5) is configured to open the fourth nonreturn valve (31) only when the third nonreturn valve (30) is closed.

15. A process for producing solid medicaments with the production module (1) as claimed in claim 1, wherein starting substances (17, 18, 19, 20) are dosed into the first collection lock (6) via dosing units (13, 14, 15, 16) of the supply device (2) in specified, highly precise quantities, as a result of which each batch is defined.

16. The process as claimed in claim 15, wherein each batch is processed separately in the supply device (2) and subsequently processed separately in the mixing device (3) and subsequently processed separately in the final processing device (4) and/or transported into a collection lock (6, 7, 9, 12) after each finished process step, where it is examined via quality sensors to determine suitability for further processing.

17. The process as claimed in claim 15, wherein each batch in the mixing device (3) is granulated and dried in only one process unit, or granulated in the mixing device (3) in an extruder or high-shear granulator, and subsequently dried in a process unit of the mixing device (3).

18. The process as claimed in claim 15, wherein further substances are fed into the second collection lock (7) with at least one additional dosing unit (21) in order to mix the respective batch with the additional substances.

19. The process as claimed in claim 15, wherein quality sensors in individual process units of the mixing device (3) evaluate quality in order to forward the respective batch to the transport network, or to manually or automatically discharge the respective lot into a waste container directly after or out of the process units of the mixing device (3), so that each batch that does not meet pre-defined quality parameters is discharged into a waste container via a point (32) before reaching the final processing device (4).

* * * * *